United States Patent [19]

Loriot

[11] Patent Number: 4,819,529

[45] Date of Patent: Apr. 11, 1989

[54] METHOD OF CUTTING OUT SHEET OR PLATE MATERIAL

[76] Inventor: Jean-Marc Loriot, 15 rue Lakanal, 75015 Paris, France

[21] Appl. No.: 929,890

[22] Filed: Nov. 13, 1986

[30] Foreign Application Priority Data

Nov. 13, 1985 [FR] France ..... 85 16721

[51] Int. Cl.[4] ..... B26D 5/00

[52] U.S. Cl. ..... 83/32; 83/49; 83/71; 83/565

[58] Field of Search ..... 83/925 CC, 32, 49, 565, 83/71

[56] References Cited

U.S. PATENT DOCUMENTS

| | | | |
|---|---|---|---|
| 3,769,488 | 10/1973 | Hasslinger | 83/925 CC X |
| 3,881,379 | 5/1975 | Stumpf | 83/49 |
| 3,899,949 | 8/1975 | Bystron | 83/565 |
| 4,554,635 | 11/1985 | Levine | 83/32 X |

*Primary Examiner*—Donald R. Schran
*Attorney, Agent, or Firm*—Sughrue, Mion, Zinn, Macpeak & Seas

[57] ABSTRACT

A method, and in particular an automatic method, of cutting parts out from sheet or plate material, the method comprising the steps of: placing templates (1, 2) having the shapes and sizes of the said parts upon said sheet or plate of material; recognizing the respective shapes, sizes, orientations, and positions of the templates on the material by means of distinctive signs characteristic of the shapes and sizes of the respective templates; and cutting out parts from said sheet or plate material along outlines defined by said templates; the method including the improvement of a further step in which any overlaps (3) between templates are detected and the lines of cut where the templates overlap are modified either by cutting along a straight line (6) interconnecting the points of intersection (4, 5) between the outlines of the overlapping templates, or by cutting along an average line (9) equidistant from the outlines of the templates between the points of intersection of the outlines of the overlapping templates, or else by cutting along the outline (7, 8) of one or other of the overlapping templates, with the type of cut being selected for each overlap zone as a function of the types of the overlapping templates and of the portions of template outlines concerned, said selections being suitable for storage in a list of possible types of cut, which list may be consulted immediately after detecting and identifying a given overlap. These overlap operations may be performed by computer.

6 Claims, 4 Drawing Sheets

METHOD OF CUTTING OUT SHEET OR PLATE MATERIAL

The present invention relates to a method of cutting out parts from sheet or plate material, in particular from animal skins or from cloth, and using templates of predetermined shapes and sizes.

BACKGROUND OF THE INVENTION

Numerous methods exist for cutting parts out from a sheet or plate or material using templates of predetermined shapes and sizes. A placer puts templates having the shapes and sizes required for the parts onto the sheet or plate of material and generally seeks to avoid having templates which overlap; thereafter the material is cut along the outlines defined by said templates.

However, in some particular applications, it may be acceptable, or indeed desirable, to allow templates to overlap during placing so long as the overlaps do not significantly spoil the quality of the finished product, for example this may save raw material.

Also, templates overlaps may be the result of inaccurate placing or of an error in the system for inputting the positions of the templates when such a system is used in the cutting out process, prior to cutting out per se.

In prior art methods, two cases may arise in the event of an overlap.

If cutting out is performed on a first-takes-all basis, then the first overlapping part to be cut out is good and the second has a defect. Unfortunately it is difficult to establish simple criteria for reliably selecting the order in which parts should be cut out.

If cutting out is performed automatically, for example by means of a laser or a water jet, both parts are fully cut out, and as a result their intersection is lost from both of them. Each part then has a defect corresponding to the full size of the overlap from the other part. This is shown in accompanying FIGS. 5*a* and 5*b*: in FIG. 5*a* two templates 1 and 2 are shown in part, and they have outlines which overlap to give points of intersection 4 and 5 and an overlap zone 3 which is shown shaded; FIG. 5*b* shows portions of the parts 1' and 2' of sheet or plate material as they would be cut out using prior art automatic methods. Each of parts 1' and 2' corresponding respectively to the templates 1 and 2 has a full defect corresponding to the entire overlap mark of the other part, and a part 3' corresponding to the overlap zone 3 is lost from both parts 1' and 2'.

One of the aims of the present invention is to provide an automatic cutting out method which makes it possible to select in advance the consequences of at least two templates overlapping, regardless of whether the overlap is voluntary or otherwise.

SUMMARY OF THE INVENTION

The present invention provides a method, and in particular an automatic method, of cutting parts out from sheet or plate material, the method comprising the steps of: placing templates having the shapes and sizes of the said parts upon said sheet or plate of material; recognizing the respective shapes, sizes, orientations, and positions of the templates on the material by means of distinctive signs characteristic of the shapes and sizes of the respective templates; and cutting out parts from said sheet or plate material along outlines defined by said templates; the method including the improvement of a further step in which any overlaps between templates are detected and the lines of cut where the templates overlap are modified either but cutting along a straight line interconnecting the points of intersection between the outlines of the overlapping templates, or by cutting along an average line equidistant from the outlines of the templates between the points of intersection of the outlines of the overlapping templates, or else by cutting along the outline of one or other of the overlapping templates, with the type of cut being selected for each overlap zone as a function of the types of the overlapping templates and of the portions of template outlines concerned, said selections being suitable for storage in a list of possible types of cut, which list may be consulted immediately after detecting and identifying a given overlap.

In an advantageous variant of the present invention, at least one of the operations of: recognizing the characteristic distinctive signs provided on the templates; detecting overlap zones; consulting the lists of types of possible cuts and selecting the types of cut appropriate to the overlap zones for cutting out said sheet or plate material; and controlling the cutting per se; may be performed by a computer loaded with suitable software. To make this possible, the lists of possible types of cut may be loaded into an electronic memory and/or onto any other form of data storage medium whose contents can be read by the computer, for example magnetic tapes or disks (including hard disks).

In some cases it may be advantageous to leave the choice of the type of cut to be used to the operator who places the templates on the material. This may be done in accordance with the present invention by providing the operator with one or more additional distinctive signs for placing in appropriate locations, for example on a template itself, with said signs being characteristic of the type of cut which is desired in one or more overlap zones. Both methods of selecting the type of cut in an overlap zone (i.e consulting a pre-established list and responding to direct operator instructions) may be used simultaneously in complementary manner.

BRIEF DESCRIPTION OF THE DRAWINGS

Implementations of the invention are described by way of example with reference to the accompanying drawings, in which.

MORE DETAILED DESCRIPTION

Figure 1:
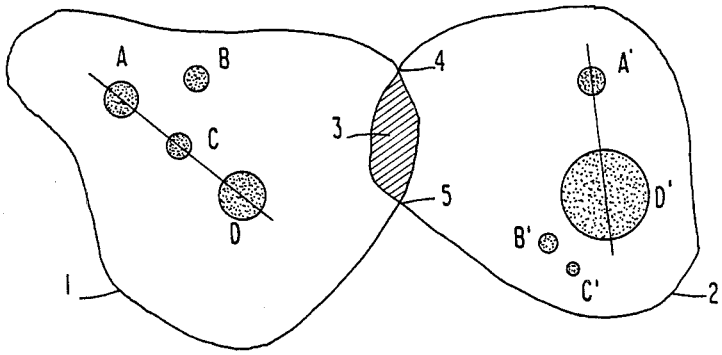
FIG. 1 shows two overlapping templates.

In FIG. 1, two templates 1 and 2 have been placed so that they include an overlap zone 3 which is shown shaded in the figure, with their respective outlines being superposed at two points of intersection 4 and 5. Each of the templates 1 and 2 is provided with a respective set of distinctive signs A, B, C, D and A', B', C', D' which are characteristic of their respective shapes and sizes.

Figure 2:
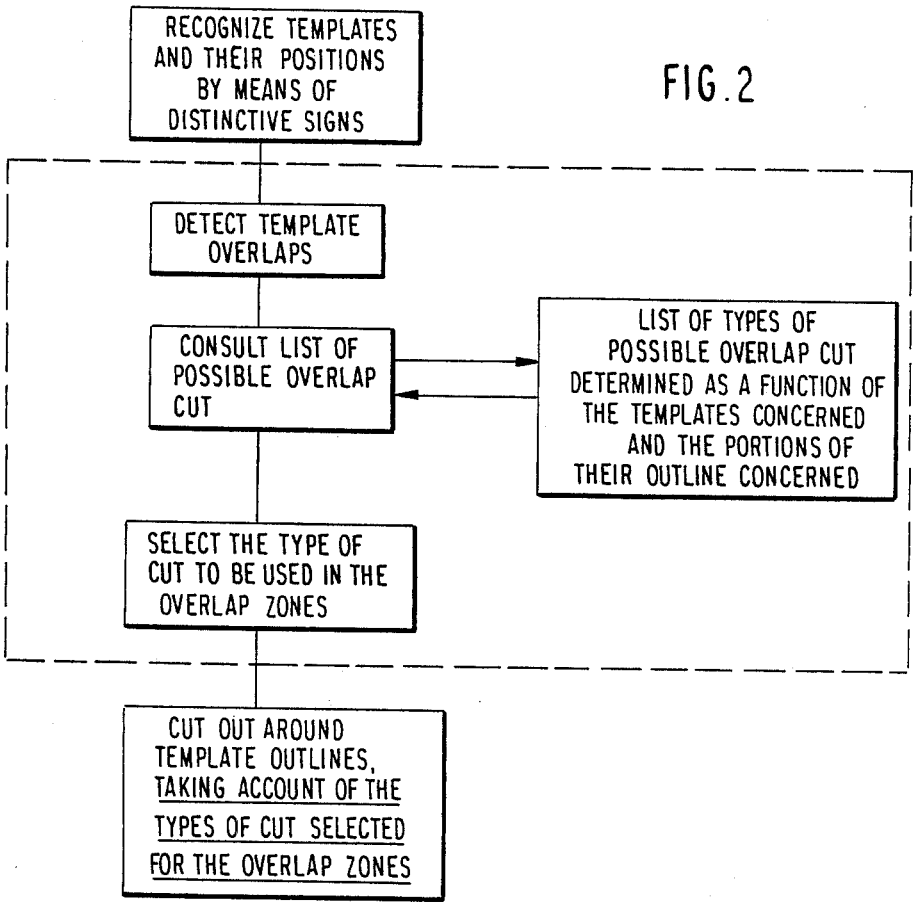
FIG. 2 is a flowchart showing the various stages of the method in accordance with the invention.

The flowchart in FIG. 2 shows the various stages of the method in accordance with the invention. The invention corresponds solely to the portion of the flowchart lying within the dot-dashed box, together with the response to the selections made regarding the overlap zones and underlined in the box corresponding to the cutting out stage. If these stages are performed by computer, the list of possible types of cut may be loaded into an electronic memory and/or onto any suitable data storage medium capable of being read by the computer, e.g. magnetic tape or disk (including a hard disk).

Figure 3:
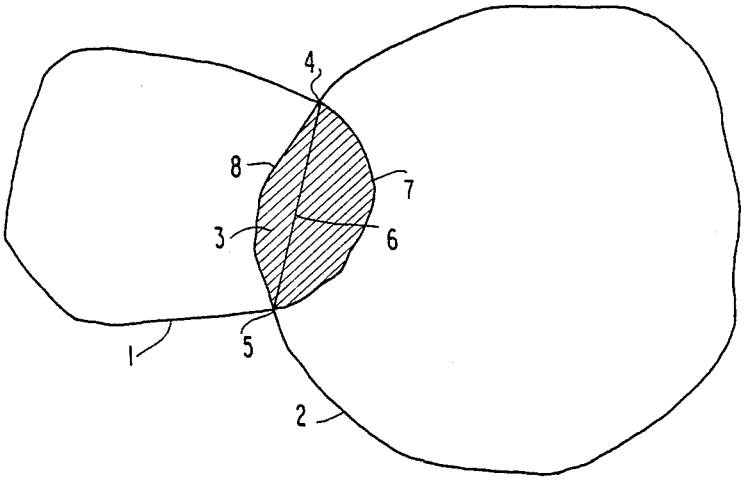
FIG. 3 is an enlarged view of two overlapping templates.

In the example shown in FIG. 3, templates 1 and 2 having respective outlines 7 and 8 define an overlap zone 3 which is shown shaded in the figure with the outlines being superposed at points of intersection 4 and 5. Instructions are contained in the list of possible cuts for overlap zones in order to determine whether the cut in the overlap zone should take place along the outline 7 of template 1, or along the outline 8 of template 2, or else along a straight line 6 joining the points of intersection 4 and 5 of the template outlines.

Figure 4:
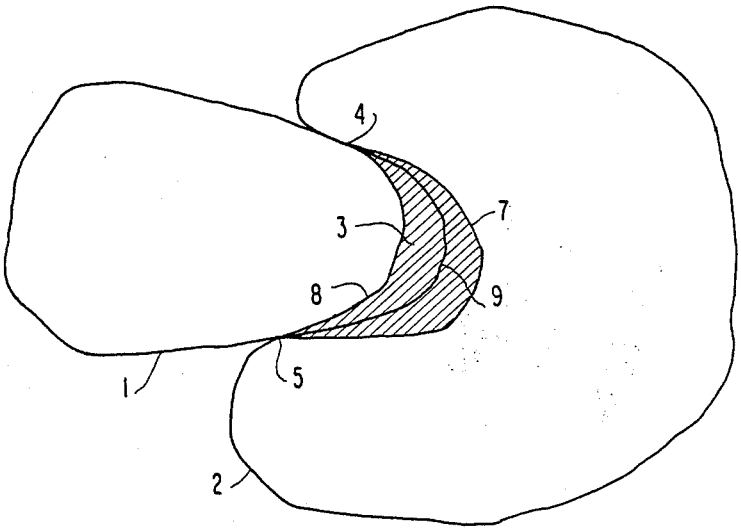
FIG. 4 is an enlarged view of two other overlapping templates.
Figure 5A:
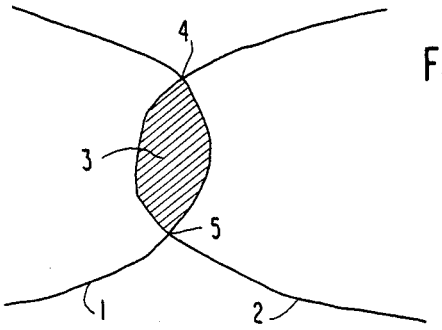
FIGS. 5*a* and 5*b* show a conventional method of automatically cutting out parts whose templates overlap.
Figure 5B:
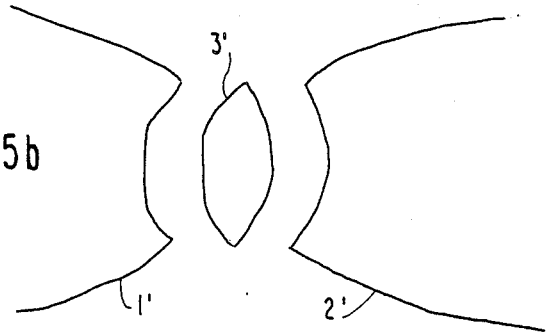

FIG. 4 shows templates 1 and 2 with respective outlines 7 and 8 defining an overlap zone 3 shown shaded in the figure with the outlines being superposed at points of intersection 4 and 5. Instructions are contained in the list of possible overlap zone cuts to specify whether the cut should take place in the overlap zone along the outline 7 of the template 1, along the outline 8 of the templae 2, or along an average line 9 equidistant from the outlines of the templates where they extend between the points of intersection 4 and 5.

Figure 6A:
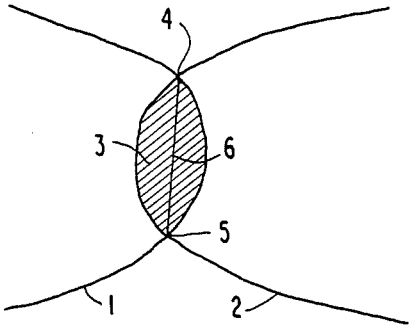
FIGS. 6*a* and 6*b* show a first type of cut in accordance with the present invention when templates overlap.
Figure 6B:
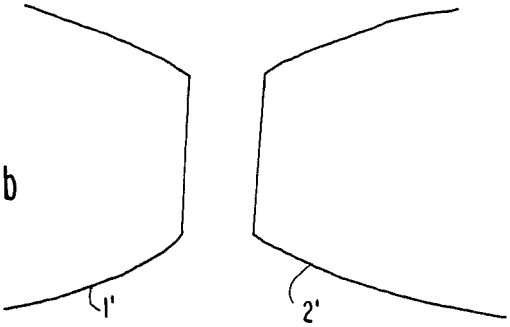

FIG. 6*a* shows portions of two templates 1 and 2 which overlap in a shaded zone 3 and whose outlines are superposed at two points of intersection 4 and 5. FIG. 6*b* shows the corresponding portions of cutout parts 1' and 2' of sheets or plate material where the cut in the overlap zone is in accordance with a first type of cut according to the present invention, i.e. along a straight line joining the points of intersection 4 and 5. The parts 1' and 2' correspond respectively to templates 1 and 2.

Figure 7A:
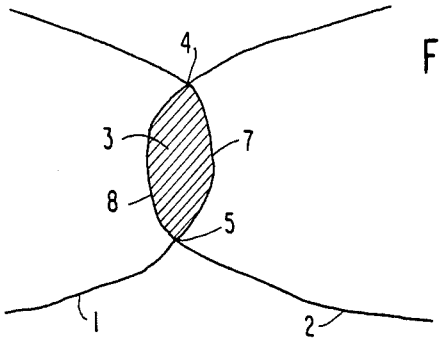
FIGS. 7*a* and 7*b* show a second type of cut in accordance with the present invention when templates overlap.
Figure 7B:
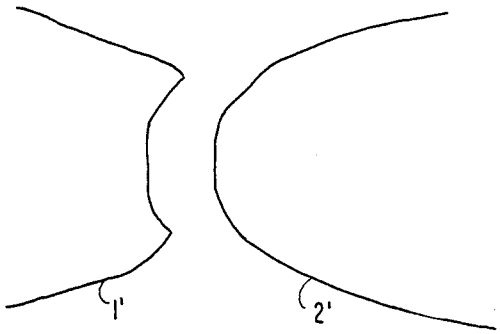

FIG. 7*a* shows portions of two templates 1 and 2 which overlap in a shaded zone 3 and whose outlines are superposed at two points of intersection 4 and 5. FIG. 7*b* shows corresponding portions of cutout parts 1' and 2' of sheet or plate material where the cut in the overlap zone is in accordance with a second type of cut according to the present invention, i.e. along the outline 8 of the template 2. The parts 1 and 2' correspond respectively to templates 1 and 2.

Figure 8A:
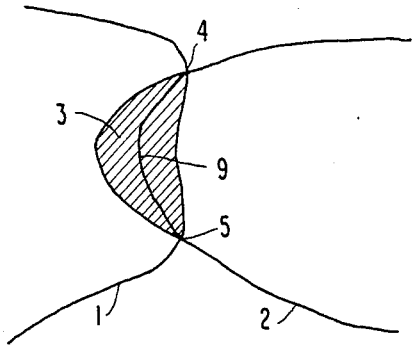
FIGS. 8*a* and 8*b* show a third type of cut in accordance with the present invention when templates overlap.
Figure 8B:
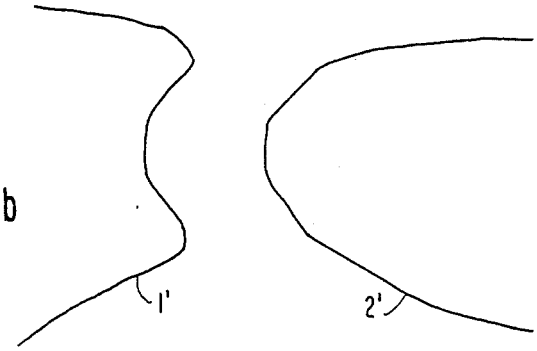

FIG. 8*a* shows portions of two templates 1 and 2 which overlap in a shaded zone 3 and whose outlines are superposed at two points of intersection 4 and 5. FIG. 8*b* shows corresponding portions of cutout parts 1' and 2' of sheet or plate material where the cut in the overlap zone is in accordance with a third type of cut according to the present invention, i.e. along a line which is equidistant from the contours of the templates between the points of intersection 4 and 5. The parts 1' and 2' correspond respectively to the templates 1 and 2.

The method of the present invention is applicable to overlaps between more than two templates.

The method of the present invention can be used to make substantial savings in raw material by allowing more templates to be placed on a given sheet or plate of material.

I claim:

1. A method of cutting parts out from sheet or plate material, the method comprising the steps of:

placing templates having the shapes and sizes of the said parts upon said sheet or plate of material;

recognizing the respective shapes, sizes, orientations, and positions of the templates on the material by means of distinctive signs characteristic of the shapes and sizes of the respective templates;

a first cutting step of cutting out parts from said sheet or plate material along outlines defined by said templates in areas not overlapped by two or more of said templates;

detecting any overlaps between templates;

determining one or more modified lines of cut where the templates have been detected to overlap according to a selected cutting mode line selected from a first cutting mode line of a straight line interconnecting the points of intersection between outlines of said overlapping temples, a second cutting mode line of an average line equidistant from the outlines of the templates between the points of intersection of the outlines of the overlapping templates, and a third cutting mode line of the outline of one or other of the overlapping templates;

selecting one of said first, second and third cutting mode lines for each detected overlap as a function of the types of the overlapping templates and of the portions of template outlines concerned; and a second cutting step of cutting out parts from said sheet or plate material along said modified line of cut.

2. A method according to claim 1, wherein said first second and third cutting mode lines are suitable for storage in a list of possible types of cuts and further comprising consulting said list after said detecting step.

3. A method according to claim 2, wherein at least one of the operations of: recognizing the characteristic distinctive signs on the templates; detecting said overlaps; consulting the list of said first, second, and third cutting mode lines and selecting said cutting mode line for cutting out said sheet or plate material; and controlling the two cutting steps is performed by a computer loaded with software.

4. A method according to claim 3, wherein said list of first, second, and third cutting mode lines is loaded into a data storage medium whose contents are capable of being read by the computer.

5. A method according to claim 1, wherein said selected cutting mode line is selected on the basis of additional distinctive signs.

6. A method according to claim 5, wherein said additional distinctive signs are placed on the sheet of plate of material by an operator.

* * * * *